US007008354B2

(12) United States Patent
Wen

(10) Patent No.: US 7,008,354 B2
(45) Date of Patent: Mar. 7, 2006

(54) ADJUSTABLE SCISSORS-ACTION EXERCISER

(75) Inventor: Samuel Wen, Taichung (TW)

(73) Assignee: Sum Sporting Goods Works, Taichung (TW)

( * ) Notice: Subject to any disclaimer, the term of this patent is extended or adjusted under 35 U.S.C. 154(b) by 104 days.

(21) Appl. No.: 10/824,377

(22) Filed: Apr. 15, 2004

(65) Prior Publication Data

US 2005/0233878 A1 Oct. 20, 2005

(51) Int. Cl.
*A63B 21/045* (2006.01)
*A63B 21/02* (2006.01)

(52) U.S. Cl. ..... 482/127; 482/121; 482/122; 482/126

(58) Field of Classification Search ..... 482/121, 482/122, 126, 127, 114, 118, 140
See application file for complete search history.

(56) References Cited

U.S. PATENT DOCUMENTS

| | | | | | |
|---|---|---|---|---|---|
| 23,744 | A | * | 4/1859 | Magida | 76/50.4 |
| 4,374,588 | A | * | 2/1983 | Ruggles | 482/118 |
| 4,762,031 | A | * | 8/1988 | Bradley | 81/57.22 |
| D341,401 | S | * | 11/1993 | Reichman | D21/692 |
| 5,507,712 | A | * | 4/1996 | Chang | 482/126 |
| 6,561,959 | B1 | * | 5/2003 | Batiste | 482/126 |

* cited by examiner

*Primary Examiner*—Stephen R. Crow
*Assistant Examiner*—Allana Lewin
(74) *Attorney, Agent, or Firm*—Browdy and Neimark, PLLC

(57) ABSTRACT

An adjustable scissors-action exerciser includes two motion arms pivotable relatively to each other and adjustably set in one of multiple operation angles. When the operation angle between the two motion arms grows beyond a predetermined angle, a locking mechanism is unlocked to allow the user to adjust the operation angle of the scissors-action exerciser. When the operation angle between the two motion arms is reduced within a predetermined angle, the locking mechanism is locked.

8 Claims, 10 Drawing Sheets

ADJUSTABLE SCISSORS-ACTION EXERCISER

BACKGROUND OF THE INVENTION

1. Field of the Invention

The present invention relates to exercising apparatuses and more particularly, to an adjustable scissors-action exerciser.

2. Description of the Related Art

A conventional scissors-action exerciser is known comprised of two pivoted motion arms and a damper (normally a spring) connected between the two motion arms. When pressing the motion arms toward each other, the damper imparts a damping resistance to the motion arms, and therefore the muscle of the user's arms, hands, or legs are exercised. However, the scissors-action exerciser is structurally not adjustable, i.e. the user cannot adjust the operation angle of the motion arms. Because the operation angle of the motion arms is fixed, it does not fit different users. If the operation angle of this design of the scissors-action exerciser is too large for one user, the user will not conveniently apply force to the motion arms, such that the inaccurate operation posture may be caused to further incur harm to the muscle. If the operation angle of this design of the scissors-action exerciser is too small for the user, the user will fail to achieve the desired exercising effect.

SUMMARY OF THE INVENTION

The present invention has been accomplished under the circumstances in view. It is one object of the present invention to provide an adjustable scissors-action exerciser, which allows the user to adjust its operation angle subject to individual operation requirement. It is another object of the present invention to provide an adjustable scissors-action exerciser, which is structurally simple and easy for operation.

To achieve the foregoing objects of the present invention, the adjustable scissors-action exerciser includes a first motion arm having a coupling end, a coupling block pivotally coupled to the coupling end and having a protruding rod, a damper provided between the first motion arm and the coupling block for generating damping resistance upon rotation of the coupling block in one direction relatively to the first motion arm, a second motion arm having a coupling end pivotally coupled to the coupling block, a plurality of chisel grooves formed in the coupling end and smoothly curvely arranged in parallel, a first protrusion, and a second protrusion, the chisel grooves each having a sloping face and a stop face asymmetric to the stop face, the sloping faces of the chisel grooves sloping in counterclockwise direction, a locking member having a middle part pivoted to the coupling block, an engagement portion at an end thereof, and a stop portion at an opposite end thereof, a first spring member connected between the locking member and the coupling block and adapted to reverse the locking member after the locking member being pressed, a limiter having a middle part pivoted to the coupling block, a first end, and a second end, and a second spring member connected between the limiter and the coupling block for reversing the limiter after the limiter is pressed.

When the first motion arm and the second motion arm are put together, the engagement portion of the locking member is engaged into one of the chisel grooves of the second motion arm, the stop portion of the locking member is stopped at the protruding rod of the coupling block, and the first end of the limiter is stopped at an outside of the stop portion.

When turning the second motion arm in counterclockwise direction relatively to the coupling block to expand the contained angle between the first motion arm and the second motion arm, the engagement portion of the locking member is moved over the sloping face of the respective chisel groove and then forced by the first spring member into engagement with a next chisel groove.

When turning the second motion arm in clockwise direction relatively to the coupling block to reduce the contained angle between the first motion arm and the second motion arm, the engagement portion of the locking member is stopped against the stop face of the respective chisel groove, thereby causing the second motion arm to move the coupling block relatively to the first motion arm.

When the contained angle between the first motion arm and the second motion arm surpassed a predetermined angle, the engagement portion is forced by the first protrusion to reverse the locking member, thereby causing the stop portion of the locking member to move over the first end of the limiter and then to press on the first end of the limiter against the projecting rod, and the second end of the limiter is disposed in a position touchable by the second protrusion and the engagement portion of the locking member is kept away from the chisel grooves, at this time the second motion arm can be turned clockwise relatively to the first motion arm till that the second end of the limiter is stopped at the second protrusion to force the first end of the limiter to move over the stop portion of the locking member and then to press on the stop portion of the locking member against the protruding rod, causing the locking member to engage the engagement portion into the chisel grooves.

DETAILED DESCRIPTION OF THE INVENTION

Figure 1:
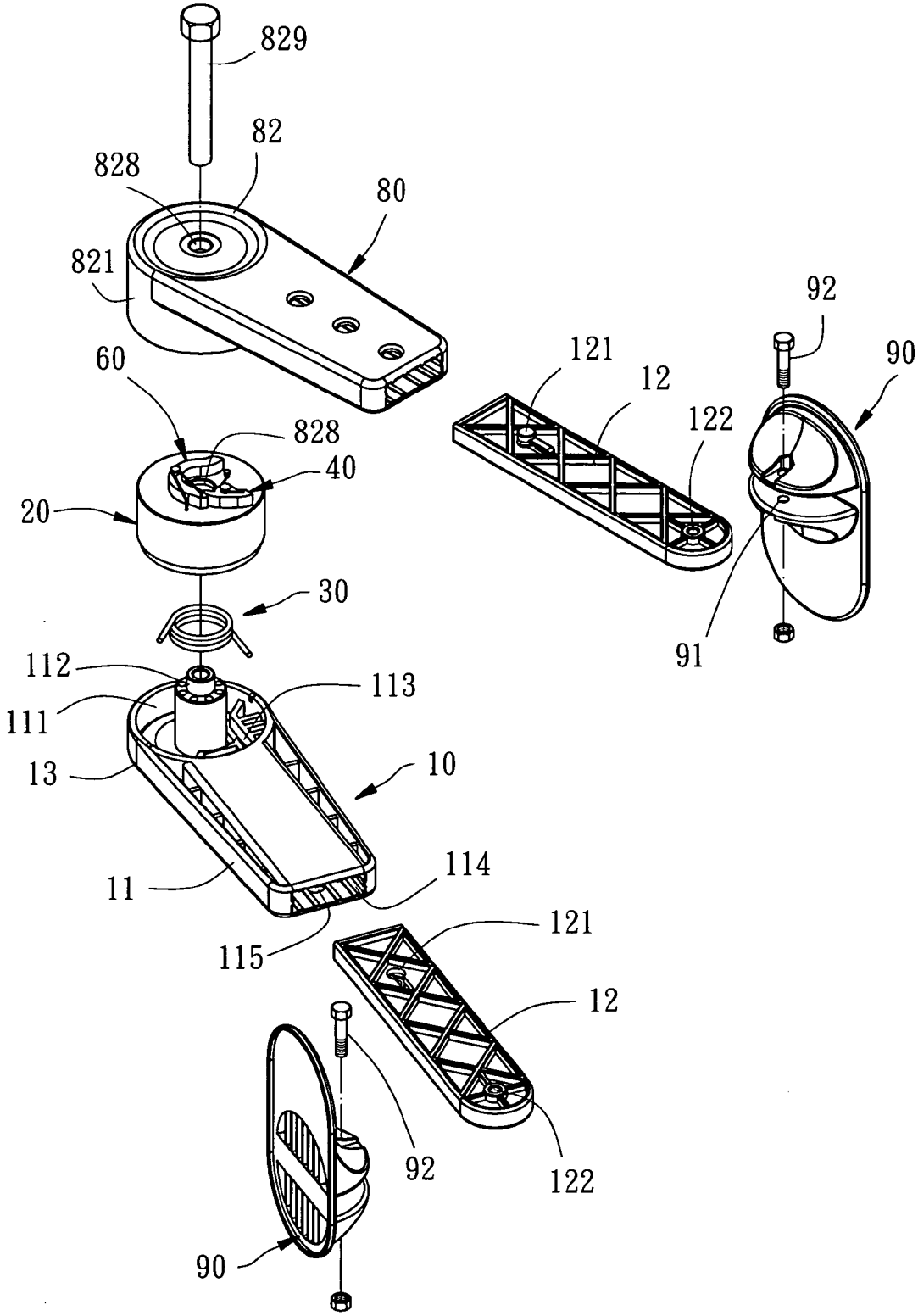
FIG. 1 is an exploded view of an adjustable scissors-action exerciser according to a preferred embodiment of the present invention.
Figure 2:
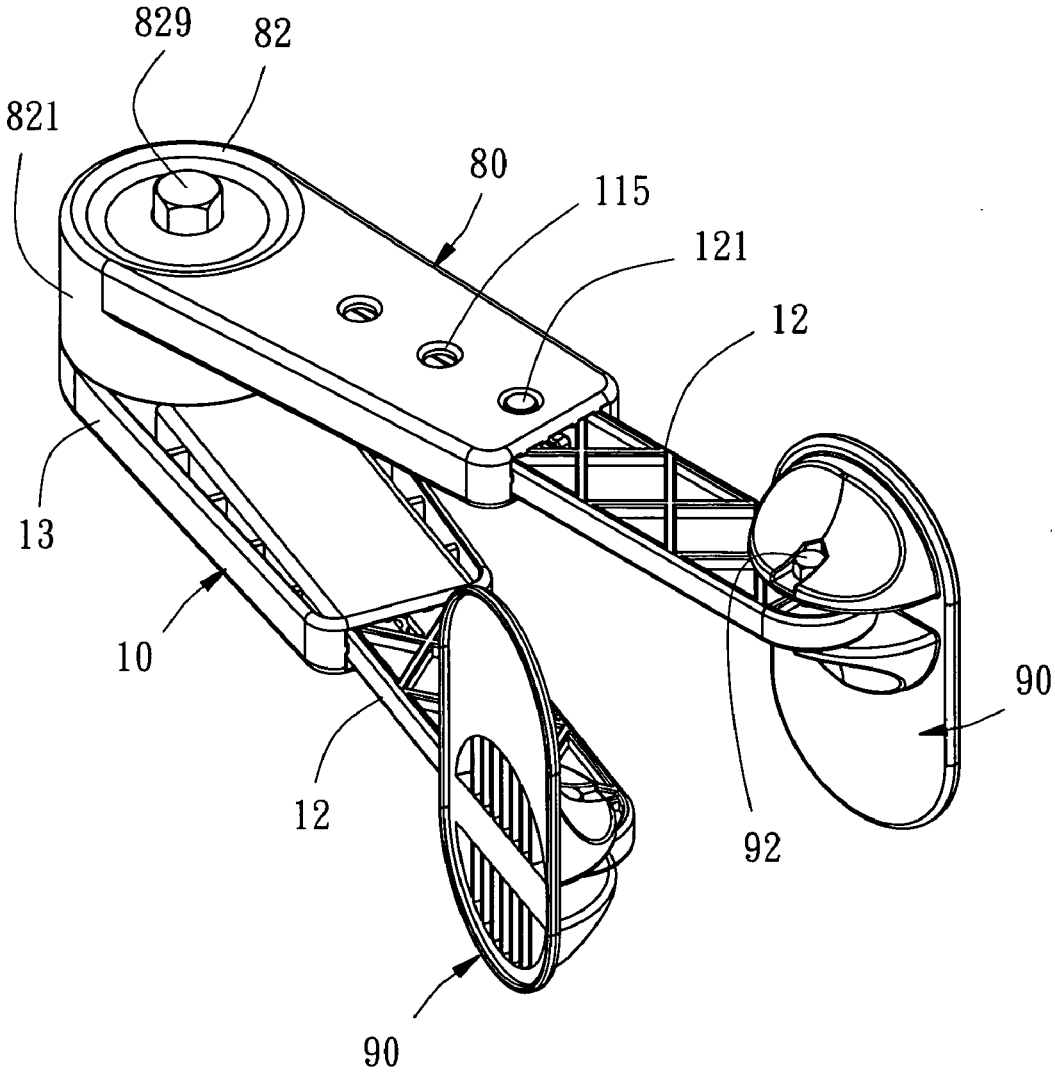
FIG. 2 is a perspective view of the adjustable scissors-action exerciser according the preferred embodiment of to the present invention.
Figure 5:
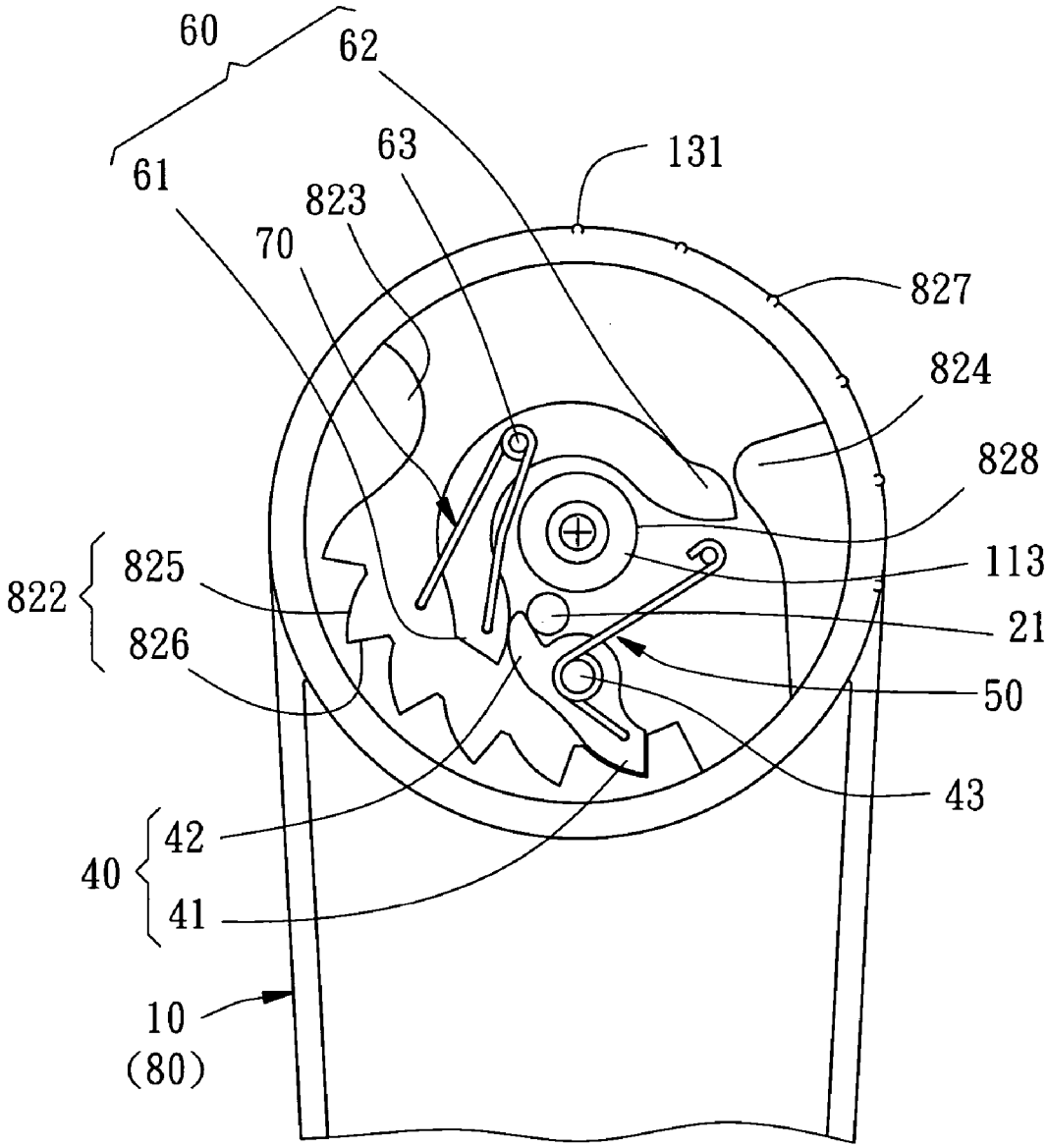
FIG. 5 is a schematic view of the adjustable scissors-action exerciser according to the preferred embodiment of the present invention, showing the relationship between a locking member and chisel grooves when two motion arms are in a collapsed position.

Referring to FIGS. 1 and 5, an adjustable scissors-action exerciser is shown comprised of a first motion arm 10, a coupling block 20, a damper 30, a locking member 40, a first spring member 50, a limiter 60, a second spring member 70, a second motion arm 80, and two baffles 90.

Figure 3:
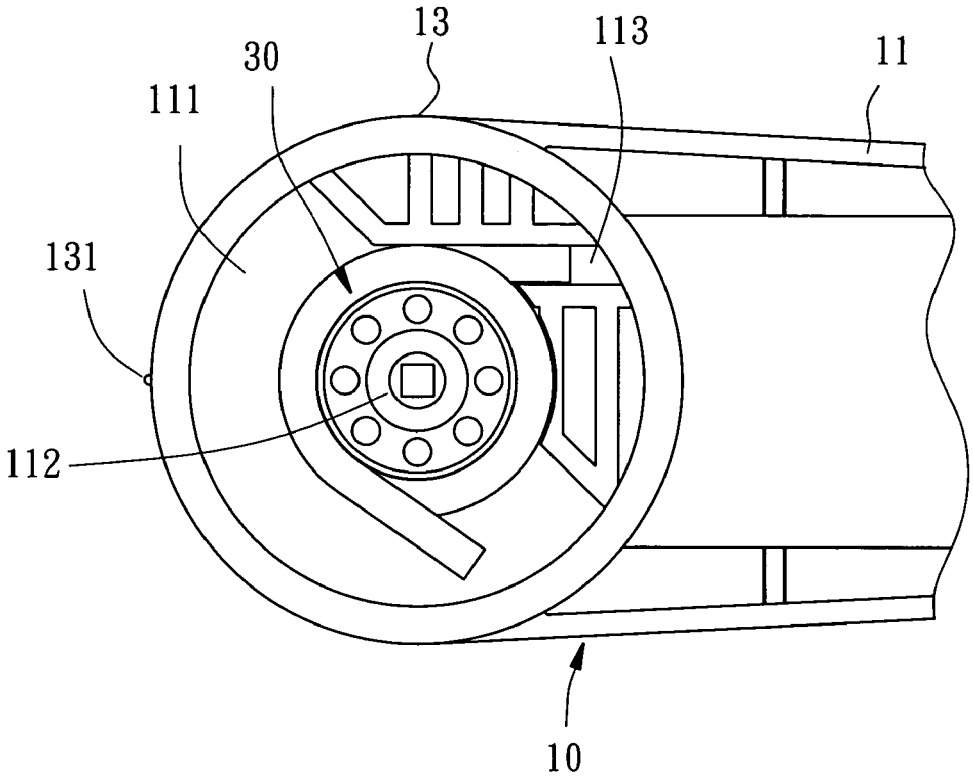
FIG. 3 is an enlarged top view of a damper of the adjustable scissors-action exerciser according to the preferred embodiment of the present invention.

Referring to FIGS. 1 and 3, the first motion arm 10 includes a main shaft 11 and an extension shaft 12. The main shaft 11 includes a recessed circular open chamber 111 formed at an end thereof defining a coupling end 13, a pivot 112 extended outwardly from a center of the circular open chamber 111, a reference point 131 protruded from an outside wall of the coupling end 13, a locating groove 113 formed at an inside wall of the coupling end 13 inside the recessed circular open chamber 11, a longitudinal sliding chamber 114 axially inwardly extended from the other end thereof, and three locating holes 115 perpendicularly outwardly extended from the longitudinal sliding chamber 114 to an outside of the main shaft 11 and longitudinally arranged at an equal interval (only one locating hole 115 is shown in FIG. 1). The extension shaft 12 is an elongated plate, having a spring retainer 121 at an end thereof and a pivot hole 122 at the other end thereof. The extension shaft 12 is axially slidably mounted into the longitudinal sliding chamber 114 and selectively locked to one of the locating holes 115 of the main shaft 11 by the spring retainer 121 for adjusting the length of the first motion arm 10.

Figure 4:
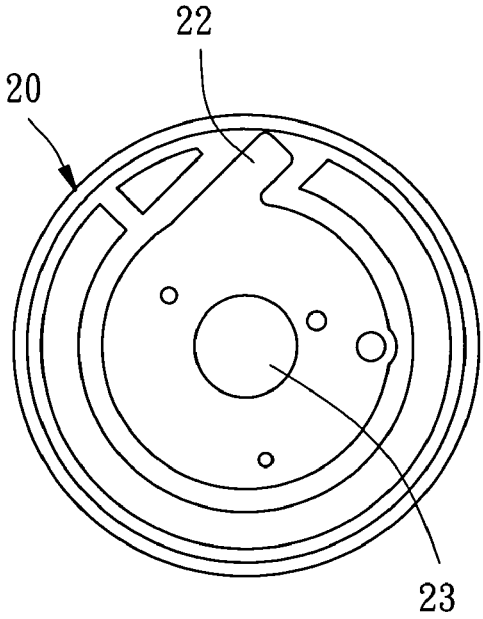
FIG. 4 is an enlarged bottom view of a coupling block of the adjustable scissors-action exerciser according to the preferred embodiment of the present invention.

Referring to FIGS. 4 and 5, the coupling block 20 is a barrel-like block fitting the diameter of the circular open chamber 111 of the main shaft 11 of the first motion arm 10, having a protruding rod 21 at a predetermined position of an outside thereof (see FIG. 5), a locating groove 22 formed at a side along an inner diameter thereof, and a pivot hole 23 axially formed at an center thereof and communicating inside and outside (see FIG. 4). By means of the pivot hole 23, the coupling block 20 is pivotally coupled to the pivot 112 of the first motion arm 10 and received in the circular open chamber 111 with an opening thereof facing downwards. Thus, the coupling block 20 can be rotatable relatively to the first motion arm 10.

The damper 30 according to the present preferred embodiment is a torsional spring set between the circular open chamber 111 of the first motion arm 10 and the coupling block 20, having an end fastened to the locating groove 113 of the first motion arm 10 and the other end fastened to the locating groove 22 of the coupling block 20. When the coupling block 20 pivots relatively to the first motion arm 20, the damper 30 is deformed to generate a return force that forces the coupling block 20 to pivotally return to the original position.

Referring to FIG. 5, the locking member 40 is an elongated member having an engagement portion 41 disposed at an end, a stop portion 42 disposed at the other end, and a pivot 43 disposed at a midsection thereof and pivotally coupled to a predetermined position of an outside of the coupling block 20.

The first spring member 50 is a torsional spring coupled to the pivot 43 of the locking member 40, having an end fastened to the engagement portion 41 of the locking member 40 and the other end fastened to the coupling member 20. By means of the first spring member 50, the locking member 40 has power of forward rotation (clockwise direction in FIG. 5) to return to the original position. Normally, the first spring member 50 forces an inner side of the stop portion 42 of the locking member 40 to be stopped against the protruding rod 21 of the coupling member 20.

The limiter 60 is an elongated member having a first end 61, a second end 62, and a pivot 63 pivotally mounted near a midsection thereof for fastening the limiter 60 to another predetermined position of the outside of the coupling block 20.

The second spring member 70 is a torsional spring coupled to the pivot 63 of the limiter 60, having an end fastened to the first end 61 of the limiter 60 and the other end fastened to the coupling block 20. By means of the second spring member 70, the limiter 60 has power of backward rotation (counterclockwise direction in FIG. 5) to return to the original position. Normally, the second spring member 70 forces an inner side of the first end 61 the limiter 60 to be stopped against the stop portion 42 of the locking member 40.

Referring to FIGS. 1 and 5, the second motion arm 80 has a configuration substantially similar to the first motion arm 10 with the exception that the coupling end 82 of the main shaft 81 is provided with a socket 821 (see FIG. 1). The socket 821 has on the inside 6 chisel grooves 822, a first protrusion 823, and a second protrusion 824 (FIG. 5). The chisel grooves 822 are smoothly curvely arranged in parallel, each having a sloping face 825 and a stop face 826. The sloping faces 825 of the chisel grooves 822 slope in one direction (counterclockwise direction in FIG. 5) and the stop faces 826 are respectively connected between inner and outer ends of each two adjacent sloping faces 825, and therefore each of the chisel grooves 822 is acute in shape. Further, peaks of each two adjacent chisel grooves 822 are spaced at an angle of substantially 15°, such that the chisel grooves 822 are disposed in the socket 821 within an angle of substantially 90°. The first protrusion 823 is disposed adjacent to a side of the last forwardly spirally extended chisel groove 822, and protruded from an inside wall of the socket 821 toward a central axis of the socket 821 for a predetermined thickness. The second protrusion 824 is protruded from an inside wall of the socket 821 toward the central axis of the socket 821 for a predetermined thickness. The second protrusion 824, the first protrusion 823, and the chisel grooves 822 are spaced from one another at a predetermined angle. Further, the coupling end 82 is provided with six marks 827 at an outer periphery thereof opposite the chisel grooves 822, and a center pivot hole 828 extended through the axial center of the socket 821. The six marks 827 are equally spaced from one another at angle of substantially 15'.

By means of the pivot hole 828, the second motion arm 80 is pivotally coupled to the pivot 112 of the first motion arm 10, the socket 821 is pivotally capped on the coupling block 20 and the engagement portion 41 of the locking member 40 is inserted into one of the chisel grooves 822. In the meantime, the reference point 131 of the first motion arm 10 is aligned with one of the marks 827 of the second motion arm 80, and a locating member 829 is inserted through the pivot hole 828 and the pivot 112 to prevent disconnection between the two motion arms 10 and 80 during exercise.

Referring to FIG. 1 again, the two baffles 90 are oval plates each having a vertically mounting hole 91 running therethrough. Each of two bolts 92 is threadedly mounted between the mounting hole 91 and the pivot hole 122 of the first arm 10 (the second arm 80). When installed, the two baffles 90 are disposed respectively at outsides of the first and second motion arms 10 and 80.

Figure 6:
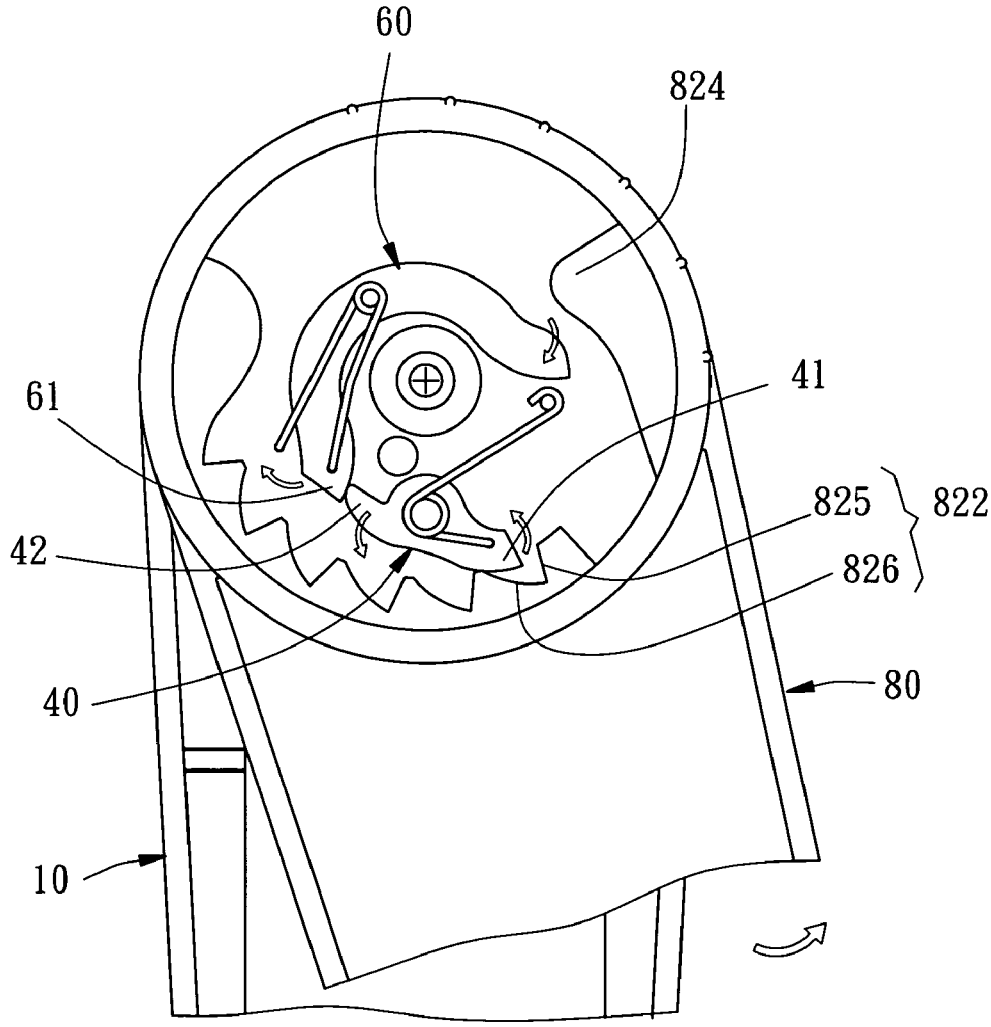
FIG. 6 similar to FIG. 5, showing the relationship between the locking member and a limiter when a second motion arm is turned outwards relatively to a first motion arm.
Figure 7:
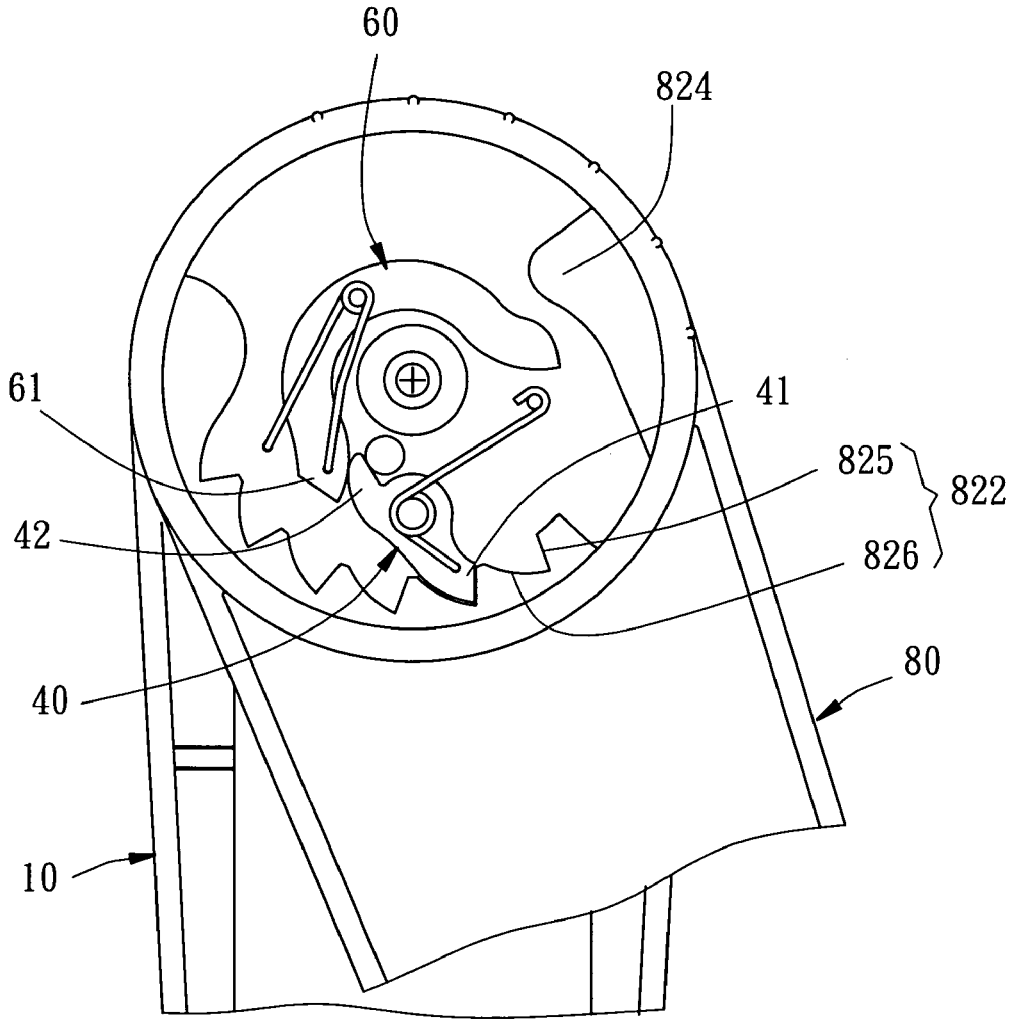
FIG. 7 is similar to FIG. 6, showing that the locking member is engaged into one of the chisel grooves.

Referring to FIGS. 5~7, when the engagement portion 41 of the locking member 40 is inserted into the foremost chisel groove 822 and the reference point 131 of the first motion arm 10 is aligned with the foremost mark 827 of the second motion arm 80, the first and second motion arms 10 and 80 are at a collapsed position. (see FIG. 5) When in use, the second motion arm 80 is turned outwards from the first motion arm 10 (i.e. the second motion arm 80 is turned in one direction relatively to the coupling block 20) to move the engagement portion 41 of the locking member 40 over the sloping face 825 of the first one of the chisel grooves 822 (see FIG. 6), for enabling the engagement portion 41 of the locking member 40 to be forced by the first spring member 50 into engagement with the next (second) one of the chisel grooves 822 (see FIG. 7). By means of this operation procedure, a contained angle between the two motion arms 10 and 80 can be selectively adjusted to one of six different angles subject to the user's requirement.

Referring to FIG. 7 again, when operating the two motion arms 10 and 80, the user's two arms or legs are respectively pressed on the baffles 90 of the motion arms 10 and 80, and then move the motion arms 10 and 80 alternately inwards and outwards with the arms or legs. At this time, the engagement portion 41 of the locking member 40 will be stopped at the stop face 826 of the respective chisel groove 822, and the second motion arm 80 will drive the coupling block 20 to pivot relatively to the first motion arm 10. During exercise, the motion arms 10 and 80 compress the damper 30 to cause the damper 30 to generate a damping resistance, against which the user can exercises, and therefore the user's muscle are trained.

Figure 8:
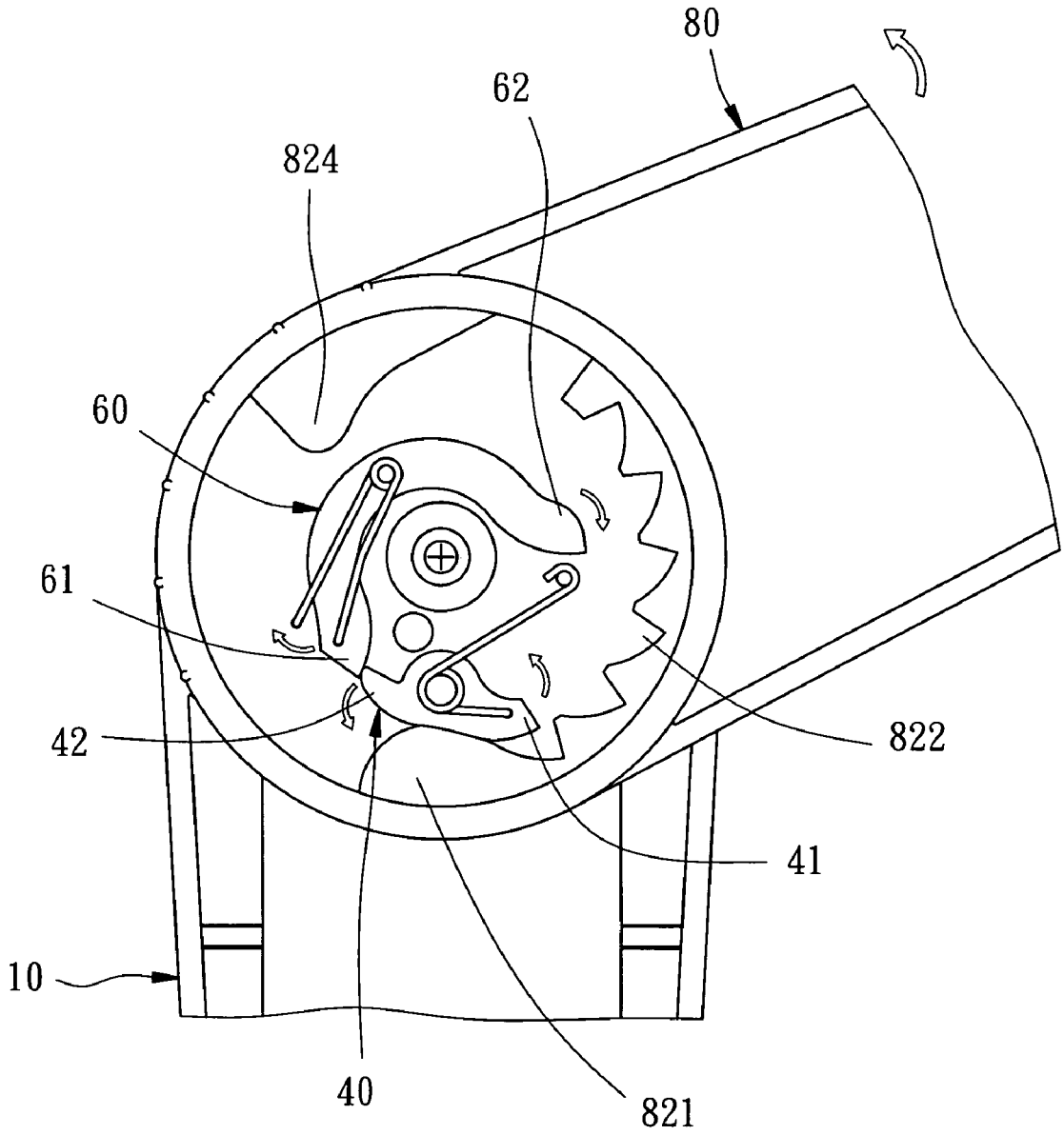
FIG. 8 is similar to FIG. 7, showing that the relationship between the locking member and the limiter when the locking member is stopped at a first protrusion.
Figure 9:
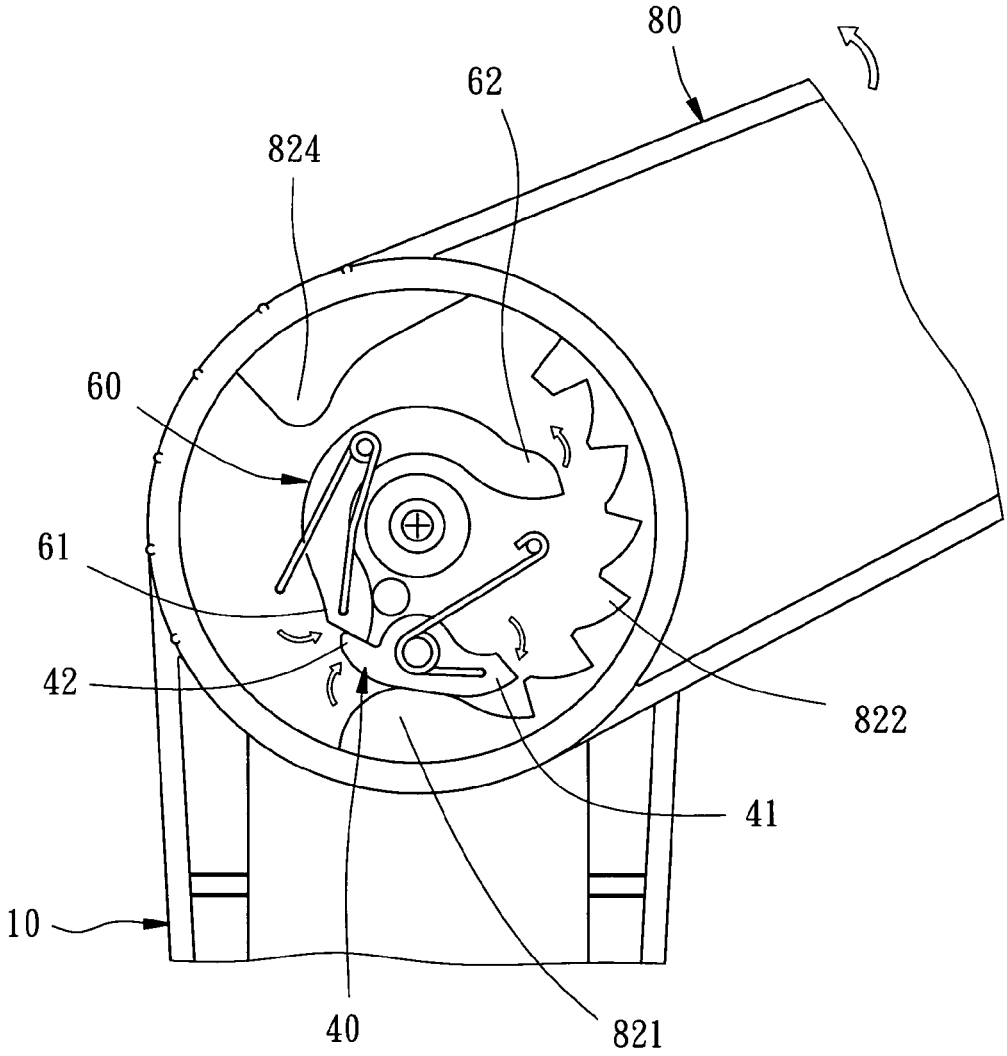
FIG. 9 is similar to FIG. 8, showing that a stop portion of the locking member is forced by a first spring member to press a first end of the limiter.
Figure 10:
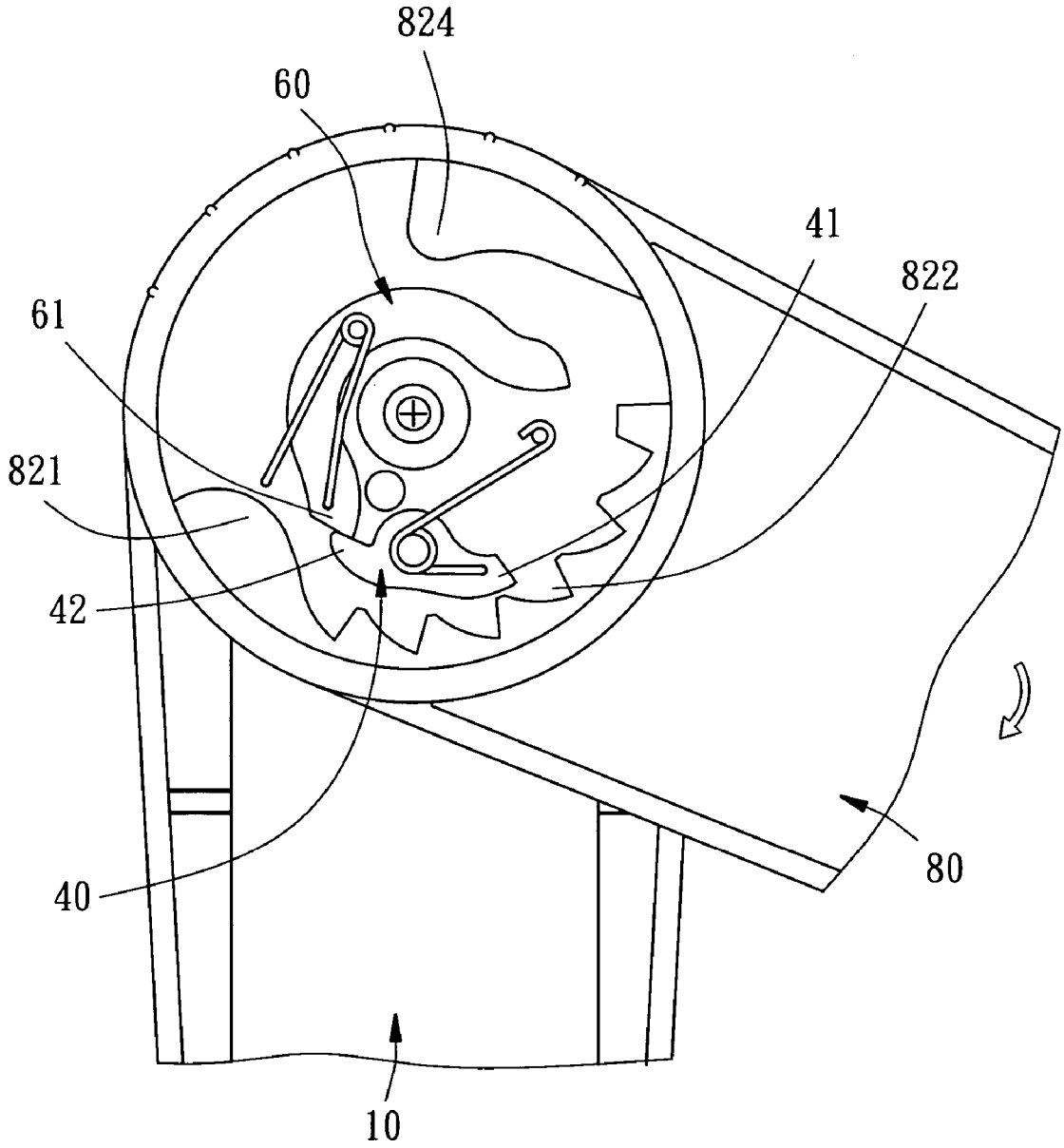
FIG. 10 is similar to FIG. 9, showing that the second motion arm is turned counterclockwise relatively to the first motion arm.
Figure 11:
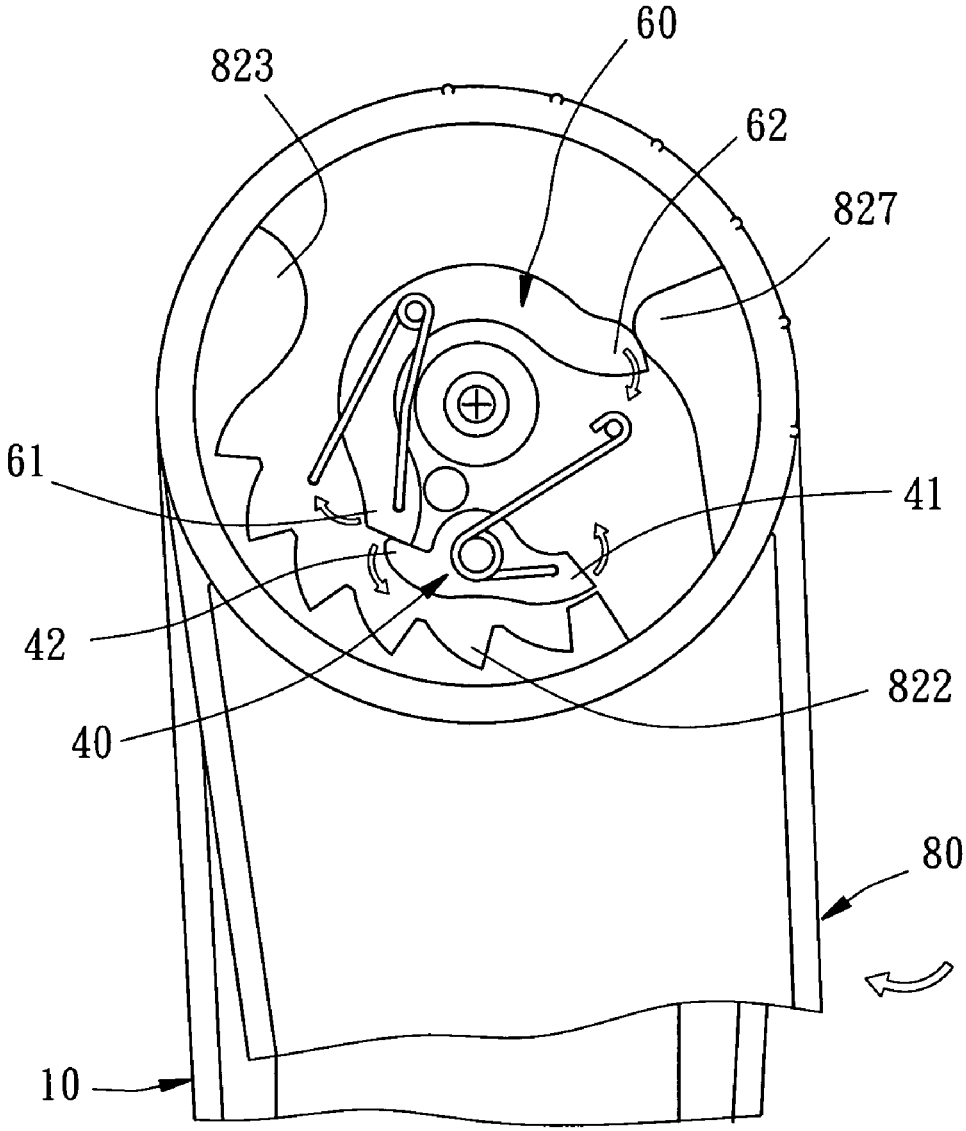
FIG. 11 is similar to FIG. 10, showing the relationship between the locking member and the limiter when a second end of the limiter is stopped at a second protrusion.

Referring to FIGS. 8 and 9, when the angle between the first and second motion arms 10 and 80 are excessively big or when the user intends to collapse the scissors-action exerciser, the user can unfold the second motion arm 80 further to let the engagement portion 41 of the locking member 40 be stopped at the first protrusion 823 (see FIG. 8) to cause the stop portion 42 of the locking member 40 to move over the first end 61 of the limiter 60 and then to press on outside of the first end 61 of the limiter 60 and to force the inner side of the first end 61 of the limiter 60 against the projecting rod 21, and meanwhile, the second end 62 of the limiter 60 is disposed in a position touchable by the second protrusion 824 (see FIG. 9) and the engagement portion 41 of the locking member 40 is kept away from the chisel grooves 822. Thus, the second motion arm 80 can freely be pivotable relatively to the first motion arm 10 and the coupling block 20. Referring to FIGS. 10 and 11 and FIG. 5 again, at this time, the user can turn the second motion arm 80 inwards toward the first motion arm 10 (see FIG. 10) to the extent that the second end 62 of the limiter 60 is stopped at the second protrusion 824.

At this time, the limiter 60 slightly pivots to move the first end 61 over the stop portion 42 of the locking member 40, thereby causing the first end 61 to press on the outside of the stop portion 42 of the locking member 40 against projecting rod 21 (see FIG. 11), and the engagement portion 41 of the locking member 40 is forced into engagement with the foremost the chisel grooves 822 to lock the two motion arms 10 and 80 at the collapsed position (see FIG. 5). Therefore, the user can adjust the desired operation angle again.

As indicated above, the scissors-action exerciser allows the user to adjust the contained angle between the motion arms 10 and 80 for operation comfortably. Further, subject to the alignment between the reference point 131 and the marks 827, the user knows the set angle between the motion arms 10 and 80. Further, the user can adjust the length of the motion arms 10 and 80, i.e. the extending status of the extension shafts 12 of the motion arm 10 and 80. This scissors-action exerciser is ergonomic to be practical in use. The baffles 90 of the motion arms 10 and 80 give a comfort touch to the user, and provide a broad area for receiving the force applied from the user.

Further, the simple structural design of the scissors-action exerciser is practical for exercising the arms and the legs through a scissors action. The invention can also be miniaturized for use in other exercise apparatuses like handgrips.

What is claimed is:

1. An adjustable scissors-action exerciser comprising:

a first motion arm having a coupling end;

a coupling block pivotally mounted to said coupling end of said first motion arm and having a protruding rod;

a damper mounted between said first motion arm and said coupling block for generating damping resistance upon rotation of said coupling block relatively to said first motion arm;

a second motion arm having a coupling end pivotally mounted to said coupling block, a plurality of chisel grooves formed at said coupling end and smoothly curvely arranged in parallel, a first protrusion, and a second protrusion, said chisel grooves each having a sloping face and a stop face asymmetric with said stop face, sad sloping faces of said chisel grooves being sloped in counterclockwise direction;

a locking member pivotally mounted to said coupling block and having an engagement portion at an end thereof and a stop portion at an opposite end thereof;

a first spring member connected between said locking member and said coupling block for generating force enabling clockwise rotation of said locking member;

a limiter pivotally mounted to said coupling block and having a first end and a second end at two opposite ends; and a second spring member connected between said limiter and said coupling block for generating force enabling counterclockwise rotation of said limiter; wherein when said first and second motion arms are at a normal position, said engagement portion of said locking member is inserted into one of said chisel grooves of said second motion arm, said stop portion of said locking member is stopped at said protruding rod of said coupling block, and the first end of said limiter is stopped at an outside of said stop portion;

when said second motion arm is turned counterclockwise relatively to said coupling block to expand a contained angle between said first and second motion arms, said engagement portion of said locking member is moved over said sloping face of said respective chisel groove and then forced by said first spring member into engagement with a next chisel groove;

when said second motion arm is turned clockwise relatively to said coupling block to reduce the contained angle between said first and second motion arms, said engagement portion of said locking member is stopped against said stop face of said respective chisel groove, thereby causing said second motion arm to drive said coupling block to turn clockwise relatively to said first motion arm;

when the contained angle between said first and second motion arms grows beyond a predetermined angle, said engagement portion is forced by said first protrusion to reverse said locking member, thereby causing said stop portion of said locking member to move over the first end of said limiter and then to press on the first end of said limiter against said projecting rod, the second end of said limiter is disposed in a position touchable by said second protrusion, and said engagement portion of said locking member is kept away from said chisel grooves; meanwhile, said second motion arm can be turned clockwise relatively to said first motion arm till that the second end of said limiter is stopped at said second protrusion to force the first end of said limiter to move over said stop portion of said locking member and then to press on said stop portion of said locking member against said protruding rod, causing said engagement portion to engage said chisel grooves.

2. The adjustable scissors-action exerciser as defined in claim 1, wherein said chisel grooves include a first chisel groove, a last chisel groove, and a plurality of intermediate chisel grooves spaced between said first chisel groove and said last chisel groove; said first motion arm and said second motion arm are selectively lockable to a collapsed angle and one of operation angles; when said first motion arm and said second motion arm are set in said collapsed angle, said first motion arm and said second motion arm are at a collapsed position, and said engagement portion of said locking member is inserted into said first chisel groove; when said first motion arm and said second motion arm are changed to another operation angle, said engagement portion of said locking member is moved out of said first chisel groove to one of said intermediate chisel grooves; when said first motion arm and said second motion arm are set at a right angle, said engagement portion of said locking member is inserted into said last chisel groove.

3. The adjustable scissors-action exerciser as defined in claim 2, wherein the number of said chisel grooves is six; said engagement portion of said locking member is shifted from one said chisel groove to a next chisel groove upon each 15° rotation of said second motion arm relatively to said first motion arm.

4. The adjustable scissors-action exerciser as defined in claim 1, wherein either of said first and second motion arms comprises a plurality of marks spaced on said coupling end thereof corresponding to said chisel grooves, and the other of said first and second motion arms comprises a reference point at a periphery of said coupling end thereof, said reference point being aligned with one of said marks when said first and second motion arms are set in one of said operation angles.

5. The adjustable scissors-action exerciser as defined in claim 1, wherein said first motion arm comprises an open chamber formed in the coupling end thereof; said coupling block is a barrel-like member pivotally mounted in said open chamber of said first motion arm; said second motion arm comprises a socket extended from sad coupling end thereof and coupled to said coupling block.

6. The adjustable scissors-action exerciser as defined in claim 5, wherein said open chamber of said first motion arm is provided with a locating groove; said coupling block comprises a locating groove; said damper is a torsional spring having two distal ends respectively fastened to said locating groove of said open chamber and said locating groove of said coupling block.

7. The adjustable scissors-action exerciser as defined in claim 1, wherein said locking member comprises a pivot pivotally mounted to said coupling block; said first spring member is a torsional spring mounted on said pivot of said locking member, having two opposite ends respectively fastened to said engagement portion of said locking member and one side of said coupling block; said limiter comprises a pivot pivotally mounted to said coupling block; said second spring member is a torsional spring mounted on said pivot of said limiter, having two opposite ends respectively fastened to the first end of said limiter and said coupling block.

8. The adjustable scissors-action exerciser as defined in claim 1, wherein said first and second motion arms each comprise a main shaft and an extension shaft axially slidably inserted into said main shaft and lockable to said main shaft.

* * * * *